US008157228B2

(12) United States Patent
Smith

(10) Patent No.: US 8,157,228 B2
(45) Date of Patent: Apr. 17, 2012

(54) TOOL FOR POSITIONING MOLDING

(75) Inventor: Patrick J. Smith, Peterborough (CA)

(73) Assignee: Smithworks, Inc., Peterborough, Ontario (CA)

( * ) Notice: Subject to any disclaimer, the term of this patent is extended or adjusted under 35 U.S.C. 154(b) by 0 days.

(21) Appl. No.: 11/950,900

(22) Filed: Dec. 5, 2007

(65) Prior Publication Data

US 2008/0135701 A1 Jun. 12, 2008

Related U.S. Application Data

(60) Provisional application No. 60/869,134, filed on Dec. 8, 2006.

(51) Int. Cl.
*F21V 21/00* (2006.01)
*F21V 35/00* (2006.01)
*A47B 96/00* (2006.01)

(52) U.S. Cl. ..... 248/222.14; 248/225.11; 248/244; 248/323

(58) Field of Classification Search ..... 52/127.1, 52/127.2, 702; 248/48.1, 48.2, 58, 59, 244, 248/225.11, 220.21, 323, 222.14, 223.41; 33/613, 626, 647–649; D8/14
See application file for complete search history.

(56) References Cited

U.S. PATENT DOCUMENTS

| | | | | |
|---|---|---|---|---|
| 368,574 | A * | 8/1887 | Eby | 33/647 |
| 514,758 | A * | 2/1894 | Lewis | 248/48.2 |
| 2,894,710 | A * | 7/1959 | Shields | 248/265 |
| 2,920,853 | A * | 1/1960 | Bufogle | 248/214 |
| 3,941,341 | A * | 3/1976 | Brogdon, Jr. | 248/55 |
| 4,164,346 | A | 8/1979 | Sickler | |
| 4,418,825 | A * | 12/1983 | Mahowald | 211/42 |
| 4,579,303 | A | 4/1986 | Midlik | |
| 5,611,189 | A * | 3/1997 | Fleck | 52/702 |
| 5,768,830 | A * | 6/1998 | Kelly | 52/127.1 |
| 5,884,876 | A * | 3/1999 | Axford | 248/48.2 |
| 6,296,208 | B1 * | 10/2001 | Franke | 246/220 |
| 6,684,521 | B2 * | 2/2004 | Rempe | 33/647 |
| 7,578,492 | B2 * | 8/2009 | Darre' | 248/477 |

FOREIGN PATENT DOCUMENTS

WO 2007127125 A2 11/2007

* cited by examiner

*Primary Examiner* — Amy J Sterling
(74) *Attorney, Agent, or Firm* — Young Basile Hanlon & MacFarlane PC

(57) ABSTRACT

A tool for positioning molding, such as crown molding, during installation, has a base member adapted to be releasably hung on a wall near the ceiling. A retaining member is vertically slidably mounted on the base member and has an upper end portion disposed at an acute angle to hold a piece of molding at a desired attitude between the retaining member and the wall. The retaining member is slid and locked in vertically and locked in position to hold the molding in place while it is fastened to the wall, after which the tool is removed from the wall.

1 Claim, 4 Drawing Sheets

TOOL FOR POSITIONING MOLDING

This application claims benefit of the filing date of and right of priority of U.S. Provisional Patent Application Ser. No. 60/869,134 filed Dec. 8, 2006. This invention relates to non-powered constructions tools, and in particular, to tools for mounting moldings, such as crown moldings.

BACKGROUND OF THE INVENTION

Field of the Invention

In the construction industry, it is often desired to install trim or moldings horizontally on a wall or other vertical surface. Usually this is a two man job, because it takes one person to hold the molding in position while the other person attaches or fastens it to the wall. The difficulty with this is that it is labour intensive and thus costly to do.

SUMMARY OF THE INVENTION

The tool of the present invention allows one person to install horizontal strips, such as trim or molding, on a vertical surface. The tool has a base member that is releasably attached to the vertical surface. A retaining member is slidably mounted on the base member for vertical movement and has an upper end portion disposed at an acute angle to hold the horizontal strip at a desired attitude. Releasable locking means allows the retaining member and thus the horizontal strip to be slid vertically into position and held there while the strip is attached to the vertical surface.

According to the invention, there is provided a tool for positioning molding, such as crown molding, during installation of the molding. The tool comprises a base member having means for releasably hanging the base member on a vertical surface. A retaining member is slidably mounted on the base member for vertical movement relative to the base member. The retaining member has an upper end portion disposed at an acute angle to the base member to hold a piece of molding in a desired attitude between the retaining member and the vertical surface. Also, means are provided for releasably locking the retaining member in position relative to the base member.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
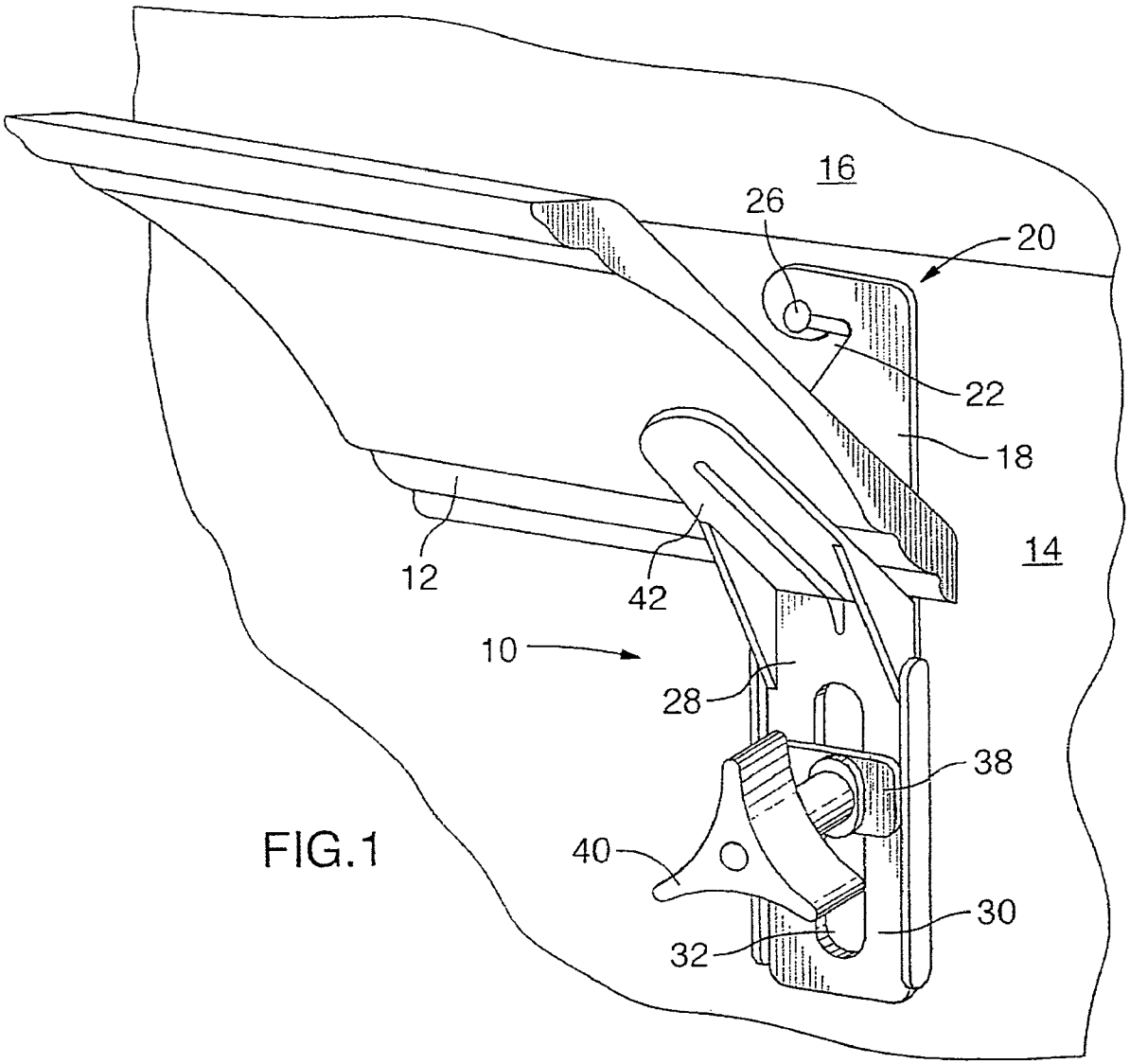
FIG. 1 is a perspective view of a preferred embodiment of a tool according to the present invention shown holding a piece of molding in position ready to be installed.

Referring to the drawings, a preferred embodiment of a tool for mounting horizontally a strip of material, such as trim or molding, is generally indicated in the drawings by reference numeral 10. In FIG. 1, the horizontal strip of material is a piece of crown molding 12, but it could be any other type of strip material desired to be attached to a vertical surface 14, such a wall, or an adjacent horizontal surface 16, such as a ceiling, located above the vertical surface 14.

Tool 10 includes a generally flat base member 18 having an upper end portion 20 which defines a slot 22 extending inwardly and upwardly from the periphery of base member 18 to the vertical center line 24 of base member 18, so that tool 10 may be releasably attached to vertical surface 14 by being hung on a nail 26 with the tool 10 hanging vertically from nail 26, the nail serving as a pintle about which the tool rotates to assume this vertical orientation. It will be appreciated that tool 10 may be removed from vertical surface 14 by being slid upwardly and horizontally off nail 26.

Tool 10 also includes a retaining member 28 having a lower portion 30 defining a slot 32. Base member 18 has a central boss 34 (see FIG. 3) that is located in slot 32, so that retaining member 28 may be slidably mounted on base member 18 for vertical sliding movement relative to base member 18. A bolt 36 passes through boss 34 and slot 32, and through a washer 38 to be threaded into a knob 40. By turning knob 40, retaining member 28 is releasably locked in position relative to base member 18. The bolt 36 and threaded knob 40 constitute a threaded fastener and are means for releasably locking the retaining member 28 in position relative to the base member 18.

Retaining member 28 also has an upper end portion 42 disposed at an acute angle relative to base member 18 and thus also to vertical surface 14. The size of this acute angle is chosen to suit the type of strip or molding 12 desired to be installed using tool 10. Where molding 12 is crown molding which is designed to be installed at an angle of 45° to the wall and ceiling, the acute angle would be roughly 45°, or such that the crown molding 12 is held at the desired attitude or 45° angle between retaining member 28 and base member 18 or vertical surface 14. For other types of molding, such as cove molding, the acute angle could be 30° or 60° or whatever makes the molding sit at the desired attitude for installation.

Figure 2:
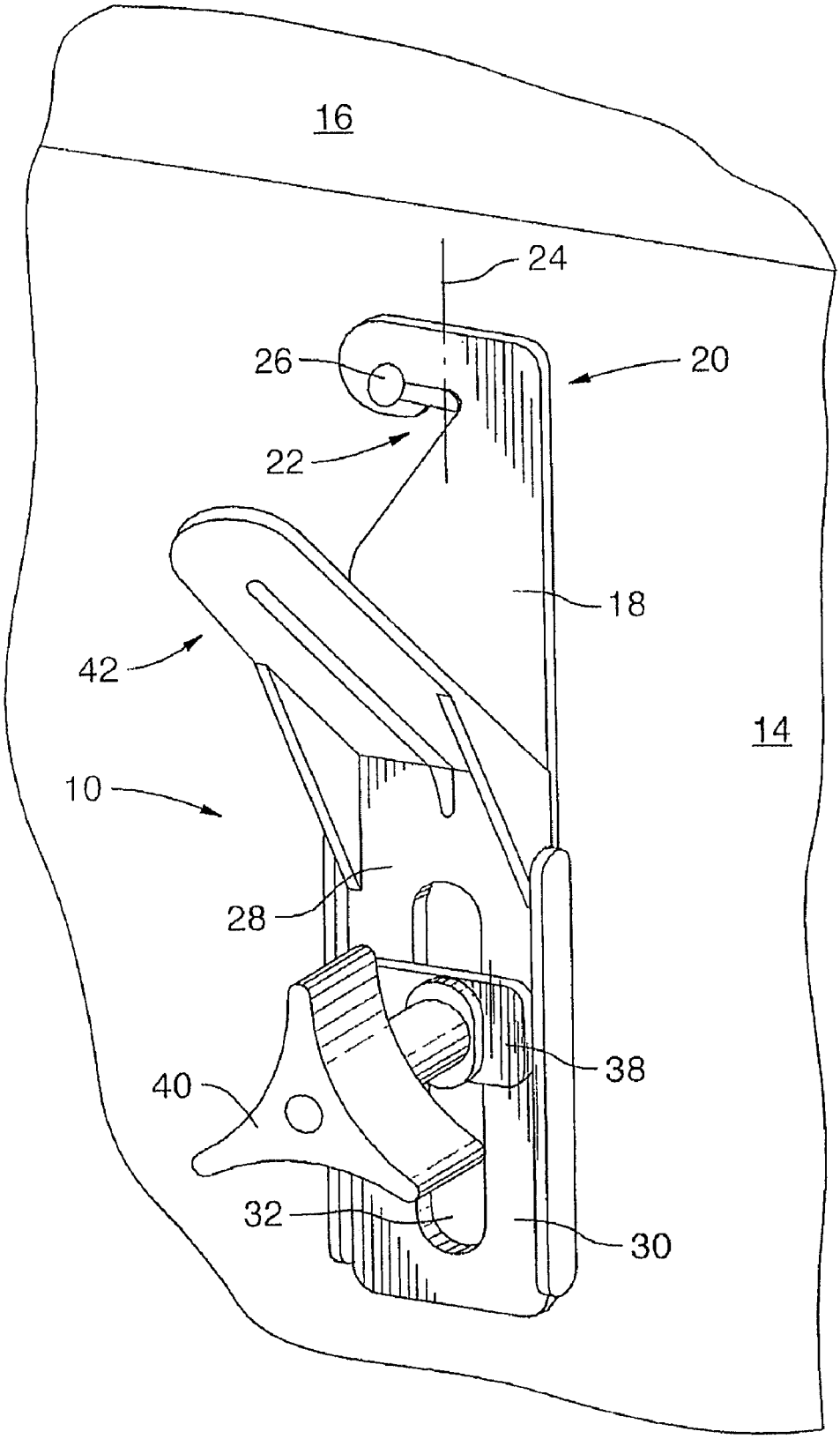
FIG. 2 is a perspective view similar to FIG. 1 but without the piece of molding.
Figure 3:
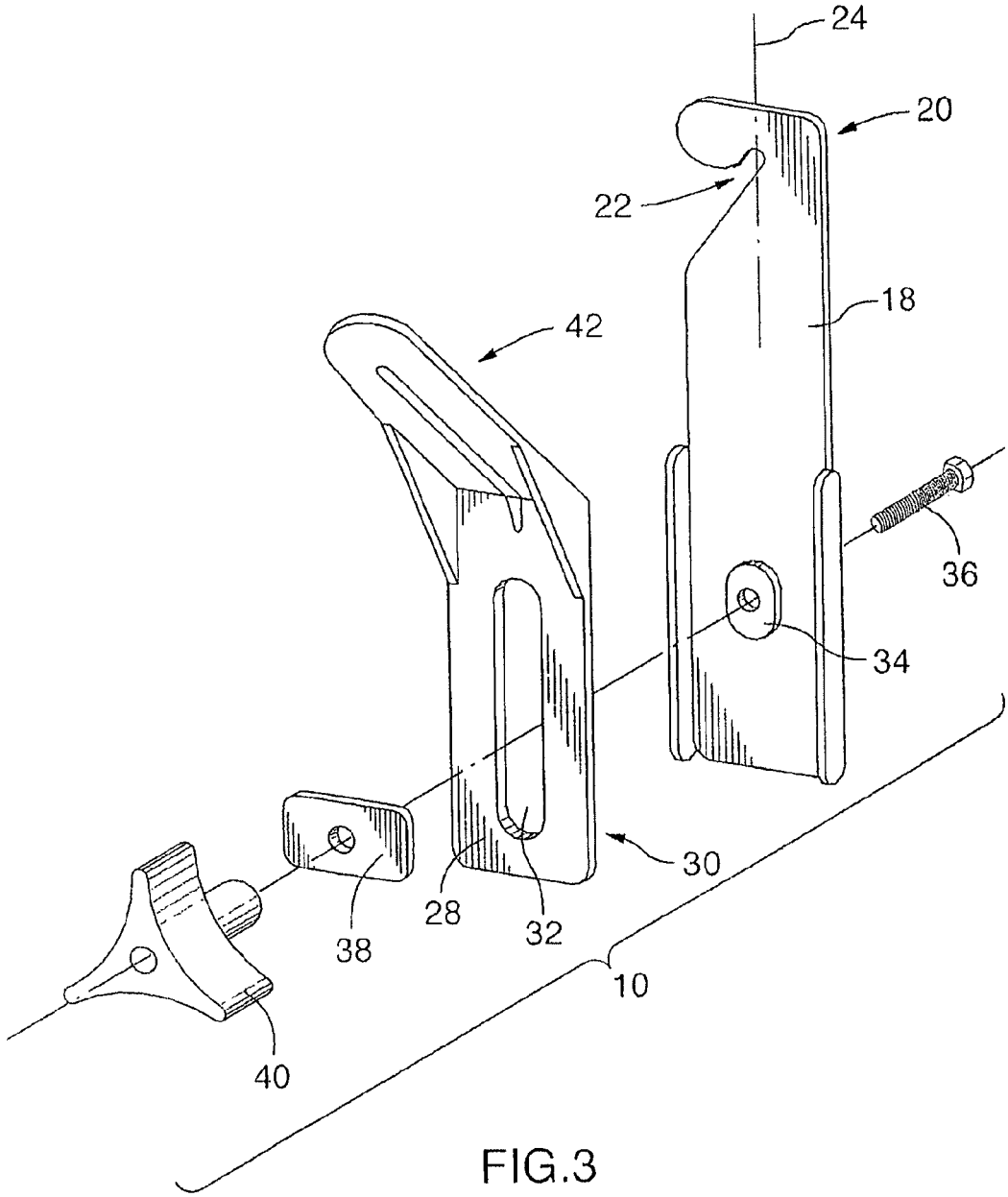
FIG. 3 is an exploded perspective view of the tool shown in FIGS. 1 and 2.
Figure 4:
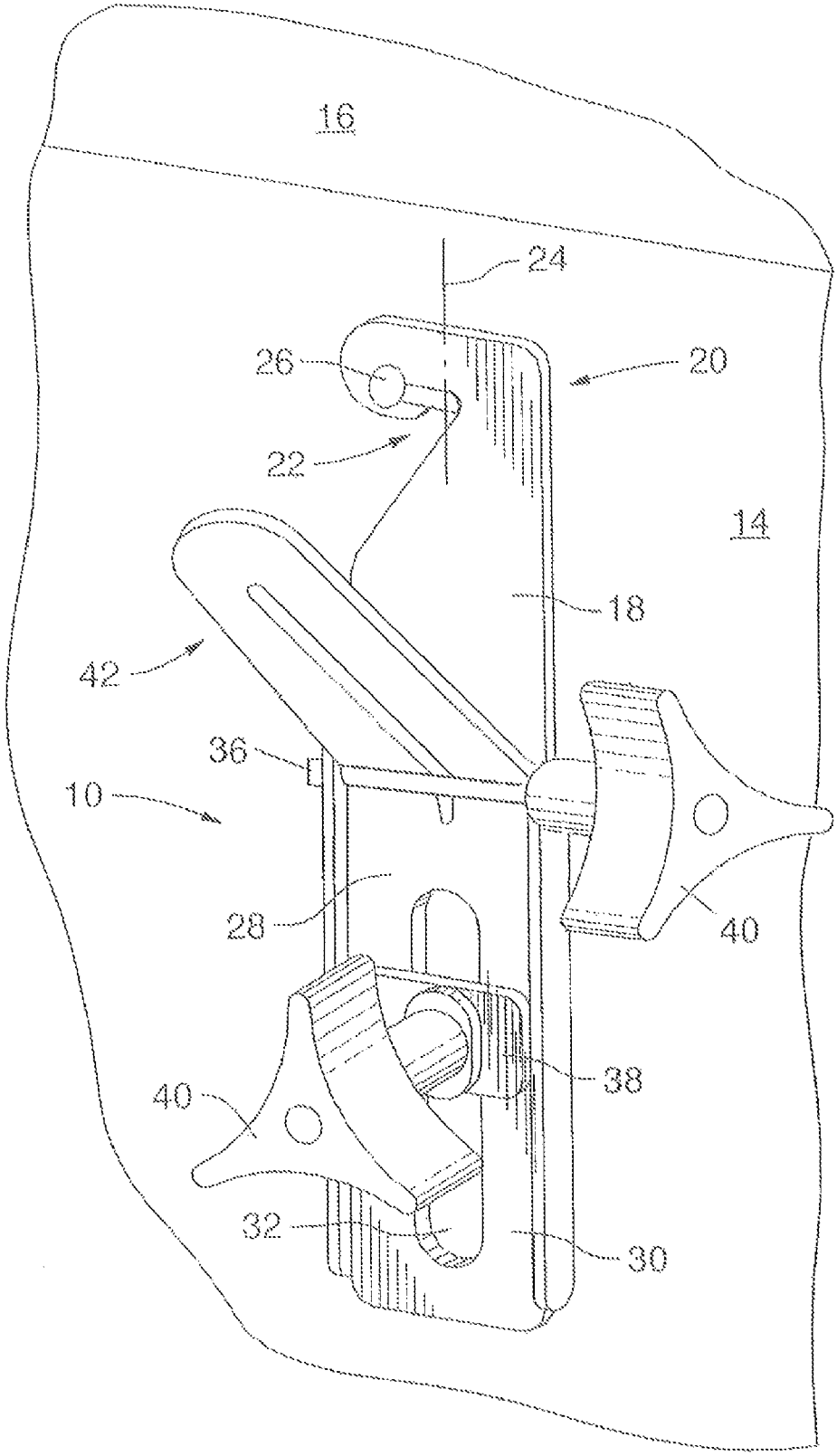
FIG. 4 is a view similar to FIG. 2, but showing another embodiment of the tool.

Although upper end portion 42 is shown in FIGS. 1-3 disposed at a fixed angle relative to the base member lower portion 30, the retaining member upper end portion 42 could be pivotally mounted in the retaining member 28 where upper portion 42 meets lower portion 30, so that the acute angle could be adjusted or varied to suit the molding being installed as shown in FIG. 4. In this application, another locking means would be used for releasably locking the upper end portion 42 at the desired angle; in FIG. 4, another threaded fastener 36, 40 is shown for the purpose.

In use, usually a pair of tools 10 are used to install a piece of molding 12, one tool 10 being located near each end of the piece of molding. Nails 26, or screws if preferred, are partially driven into vertical surface 14 near the ceiling or horizontal surface 16. The tools 10 are then hung on nails 26. Threaded fasteners 36, 40 are then backed off or released and retaining members 28 are slid downwardly into a lower position and the piece of molding is then suspended in position on the two tools 10 resting on the inclined upper end portions 42 of retaining members 28. The retaining members 28 are then slid upwardly until the molding 12 engages ceiling 16. Knobs 40 are then tightened to hold the molding in this position, and the molding is then fastened to the wall 14 or ceiling 16, or both, using nails or screws as desired. After the molding 12 is nailed or screwed into place, knobs 40 are backed off or unscrewed to release retaining members 28 allowing them to be slid downwardly to the lowermost position. The base members 18 can then be slid upwardly and to the side off nails 26 and tools 10 slipped downwardly out from beneath molding 12. Additional fasteners can then be used to further attach the molding to the wall 14 or ceiling 16 if so desired.

Having described preferred embodiments of the invention, it will be appreciated that various modifications may be made to the structures described above. For example, instead of the base member upper end portion 20 extending above retaining member 28, base member 18 could be made shorter, or retaining member lower portion 30 made longer, so that retaining member upper end portion 42 extends above the upper end portion 20 of base member 18. In this configuration, base member 18 would probably be positioned lower on vertical surface 14, and if retaining member 28 was required to be slid upwardly over nail 26, retaining member 28 or base member 18 would be modified to provide clearance for nail 26. Molding 12 would then be held directly in contact with wall 14 and ceiling 16.

Retaining member 28 could be locked in position on base member 18 in other ways than using bolt 36 and knob 40. Although tool 10 is preferably made out of metal, it could be made out of a suitable plastic or other material that is strong enough.

From the foregoing, it will be evident to persons of ordinary skill in the art that the scope of the present invention is limited only by the accompanying claims, purposely construed.

The invention claimed is:

1. A molding installation tool comprising:

a generally flat base plate having a hooked top end coplanar with said base plate for hanging said base plate to a projecting member and a pair of opposed side flanges along a lower end;

a molding retainer member having a first flat portion which fits slidably between said flanges to be contained thereby and a second flat portion extending away from the first flat portion at an acute angle to receive a molding strip between the second flat portion and the hooked top of the base plate; and a turn-to-lock fastener means cooperatively arranged between said base plate and said first flat portion to selectively lock the retainer member in any of various longitudinal positions relative to said base plate;

said fastener means including a slot in at least one of said plate and said first flat portion.

* * * * *